United States Patent [19]

Hall et al.

[11] 4,363,629

[45] Dec. 14, 1982

[54] HYDRAULIC SYSTEM FOR OUTBOARD MOTOR WITH SEQUENTIALLY OPERATING TILT AND TRIM MEANS

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 183,209

[22] Filed: Sep. 2, 1980

[51] Int. Cl.[3] ..... B63H 5/12

[52] U.S. Cl. ..... 440/61; 440/55; 440/53; 91/422; 248/642

[58] Field of Search ..... 440/53, 55, 56–63, 440/65, 900; 248/640–643; 91/422; 92/181 R, 181 P, 172, 175

[56] References Cited

U.S. PATENT DOCUMENTS

| | | | |
|---|---|---|---|
| 2,954,192 | 9/1960 | Baird | 248/641 |
| 3,581,702 | 6/1971 | Moberg | 440/61 |
| 3,648,645 | 3/1972 | Ezell | 440/63 |
| 3,722,455 | 3/1973 | Carpenter | 440/61 |
| 3,847,198 | 11/1974 | Shimanckas | 440/61 |
| 3,855,517 | 5/1975 | Borst | 440/61 |
| 3,863,592 | 2/1975 | Borst | 440/61 |
| 3,983,835 | 10/1975 | Hall | 440/61 |
| 4,050,359 | 9/1977 | Mayer | 91/422 |
| 4,064,824 | 12/1977 | Hall | 440/61 |
| 4,096,820 | 6/1978 | Hall | 440/61 |
| 4,177,747 | 12/1979 | Richl | 440/61 |

*Primary Examiner*—Trygve M. Blix
*Assistant Examiner*—D. W. Keen
*Attorney, Agent, or Firm*—Michael, Best & Friedrich

[57] ABSTRACT

Disclosed herein is a marine propulsion device comprising a transom bracket adapted to be connected to a boat transom, a first pivot connecting a stern bracket to the transom bracket for pivotal movement of the stern bracket relative to the transom bracket about a first pivot axis which is horizontal when the transom bracket is boat mounted, a second pivot connecting a swivel bracket to the stern bracket below the first pivot for pivotal movement of the swivel bracket with the stern bracket and relative to the stern bracket about a second pivot axis parallel to the first pivot axis, a king pin pivotally connecting a propulsion unit including a rotatably mounted propeller to the swivel bracket for steering movement of the propulsion unit relative to the swivel bracket about a generally vertical axis and for common pivotal movement with the swivel bracket in a vertical plane about the first and second horizontal axes, a trim cylinder-piston assembly pivotally connected to the stern bracket and to the swivel bracket, a tilt cylinder-piston assembly pivotally connected to the transom bracket and to the stern bracket, and a fluid conduit system communicating between a source of pressure fluid and each of the tilt cylinder-piston assembly and the trim cylinder-piston assembly and including apparatus operable, during reverse operation of the propulsion unit, for causing initial full extension to the trim cylinder-piston assembly, followed by extension of the tilt cylinder-piston assembly, and for causing initial full contraction of the tilt cylinder-piston assembly, followed by subsequent contraction of the trim cylinder-piston assembly.

10 Claims, 5 Drawing Figures

HYDRAULIC SYSTEM FOR OUTBOARD MOTOR WITH SEQUENTIALLY OPERATING TILT AND TRIM MEANS

RELATED APPLICATIONS

Reference is hereby made to the following related applications, all of which are assigned to the assignee of this application and all of which are incorporated herein by reference:

Stevens application Ser. No. 159,480, filed June 16, 1980, and entitled OUTBOARD MOTOR WITH ELEVATED HORIZONTAL PIVOT AXIS Blanchard application Ser. No. 167,337, filed July 9, 1980, and entitled OUTBOARD MOTOR WITH DUAL TRIM AND TILT AXES Hall et al. application Ser. No. 173,159, filed July 28, 1980, and entitled OUTBOARD MOTOR WITH TILT LINKAGE INCLUDING PIVOT LINK Hall et al. application Ser. No. 153,159, filed July 28, 1980, and entitled MARINE PROPULSION DEVICE STEERING MECHANISM Hall et al application Ser. No. 173,160, filed July 28, 1980, and entitled OUTBOARD MOTOR WITH SEQUENTIALLY OPERATING TILT AND TRIM MEANS Hall et al application Ser. No. 173,162, filed July 28, 1980, and entitled LATERAL SUPPORT ARRANGEMENT FOR OUTBOARD MOTOR WITH SEPARATE TILT AND TRIM AXIS

BACKGROUND OF THE INVENTION

The invention relates generally to marine propulsion devices and, more particularly, to outboard motors including propulsion units which are steerable in a horizontal plane and tiltable in a vertical plane.

The invention also relates to hydraulic systems for power tilting of propulsion units between a lower normal running position in which the propeller is submerged in water, and a tilted or raised position in which the propeller is located for above-the-water-accessiblity. Still more particularly, the invention relates to control of tilting and trimming during reverse outboard motor operation.

Various arrangements for power tilting and/or trimming of marine propulsion units are set forth in the following U.S. patents:

| | | |
|---|---|---|
| Carpenter | 3,722,455 | March 27, 1973 |
| Shimanckas | 3,847,198 | November 12, 1974 |
| Borst | 3,863,592 | February 4, 1975 |
| Borst | 3,885,517 | May 27, 1975 |
| Hall | 3,983,835 | October 5, 1976 |
| Hall | 4,064,824 | December 27, 1977 |
| Hall | 4,096,820 | June 27, 1978 |
| Pichl | 4,177,747 | December 11, 1979 |

SUMMARY OF THE INVENTION

The invention provides a marine propulsion device comprising transom bracket means adapted to be connected to a boat transom, first pivot means connecting a stern bracket to the transom bracket means for pivotal movement of the stern bracket relative to the transom bracket means about a first pivot axis which is horizontal when the transom bracket means is boat mounted, second pivot means connecting a swivel bracket to the stern bracket below the first pivot means for pivotal movement of the swivel bracket with the stern bracket and relative to the stern bracket about a second pivot axis parallel to the first pivot axis, means pivotally connecting a propulsion unit, including a rotatably mounted propeller, to the swivel bracket for steering movement of the propulsion unit relative to the swivel bracket about a generally vertical axis and for common pivotal movement with the swivel bracket in a vertical plane about the first and second horizontal axis, a trim cylinder-piston assembly pivotally connected to the stern bracket and to the swivel bracket, a tilt cylinder-piston assembly pivotally connected to the transom bracket and to the stern bracket, and a fluid conduit system communicating between a source of pressure fluid and each of the tilt cylinder-piston assembly and the trim cylinder-piston assembly and including means operable, during upward tilting and reverse operation of the propulsion unit, for causing initial full extension of said trim cylinder-piston assembly, followed by extension of said tilt cylinder-piston assembly and, during downward tilting and reverse operation of the propulsion unit, for causing initial full contraction of said tilt cylinder-piston assembly, followed by subsequent contraction of said trim cylinder-piston assembly.

In one embodiment in accordance with the invention, the trim cylinder-piston assembly includes a trim piston rod having a first end pivotally connected to one of the stern bracket and the swivel bracket and having a second end, a trim piston fixed on the second end of the trim piston rod, and a trim cylinder receiving the trim piston and having a first end through which the trim piston rod passes and a second end pivotally connected to the other of the swivel bracket and the stern bracket.

In addition, the tilt cylinder-piston assembly comprises a tilt piston rod having a first end pivotally connected to one of the transom bracket means and the swivel bracket and having a second end, a tilt piston fixed to the second end of the tilt piston rod, a tilt cylinder receiving the tilt piston and having a first end through which the tilt piston rod passes and a second end pivotally connected to the other of the transom bracket means and the stern bracket.

Still further in addition, the means operable for causing initial full extension of the trim cylinder-piston assembly followed by extension of the tilt cylinder-piston assembly comprises a first conduit communicating between the source of pressure fluid and the first end of the tilt cylinder and including valve means normally biased closed, and a second conduit communicating between the source of pressure fluid and the first end of the trim cylinder and including valve means normally biased closed.

In one embodiment of the invention, the means operable for causing initial full contraction of the tilt cylinder-piston assembly followed by subsequent contraction of the trim cylinder-piston assembly comprises conduit means communicating between the source of pressure fluid and the second end of the trim cylinder and including valve means normally biased closed so as to prevent flow in the conduit means from the trim cylinder to the source of pressure fluid.

In one embodiment of the invention, the means for causing initial full contraction of the tilt cylinder-piston assembly followed by subsequent contraction of the trim cylinder-piston assembly includes means for opening the valve means in the conduit means upon full contraction of the tilt cylinder-piston assembly.

In one embodiment of the invention, the conduit means includes a third conduit communicating between the source of pressure fluid and the second end of the tilt cylinder and a fourth conduit communicating between the second ends of the tilt and trim cylinders and including the valve means in the conduit means.

In one embodiment of the invention, the means for opening the valve means in the conduit means comprises a floating piston located in the tilt cylinder between the tilt piston and the second end of said tilt cylinder and including means thereon engageable with the valve means in the conduit means for opening thereof upon full contraction of the tilt cylinder-piston assembly, whereby thereafter to permit drainage from the second end of the trim cylinder responsive to contraction of the trim cylinder-piston assembly.

In one embodiment of the invention, the tilt piston includes first check valve means affording fluid flow in the direction from the first tilt piston rod end to the second rod end, and second check valve means affording fluid flow in the opposite direction.

In one embodiment in accordance with the invention, the first pivot means is located rearwardly of the boat transom and the first and second pivot axis are spaced apart with the second pivot axis located below the first pivot axis.

Other features and advantages of the embodiments of the invention will become known by reference to the following general description, claims and appended drawings.

IN THE DRAWINGS

Figure 1:
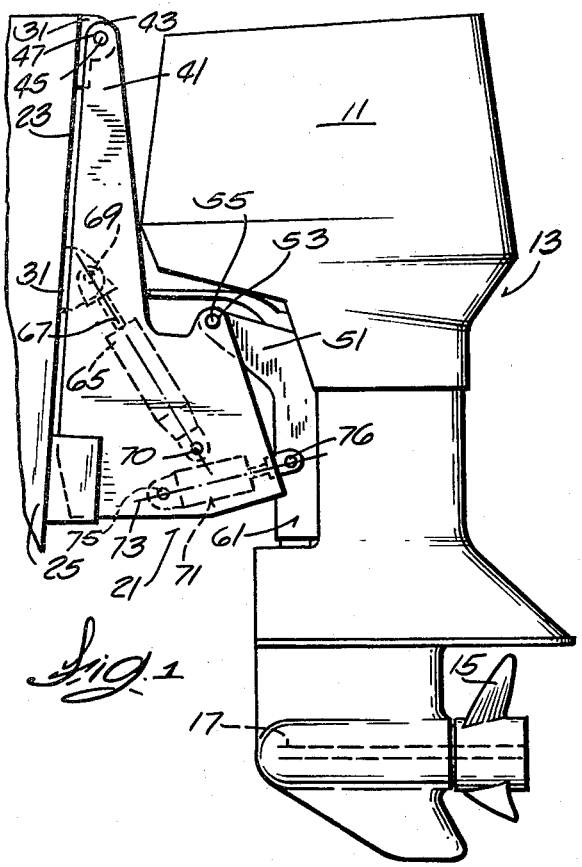
FIG. 1 is a side elevational view of an outboard motor incorporating various of the features of the invention.
Figure 2:
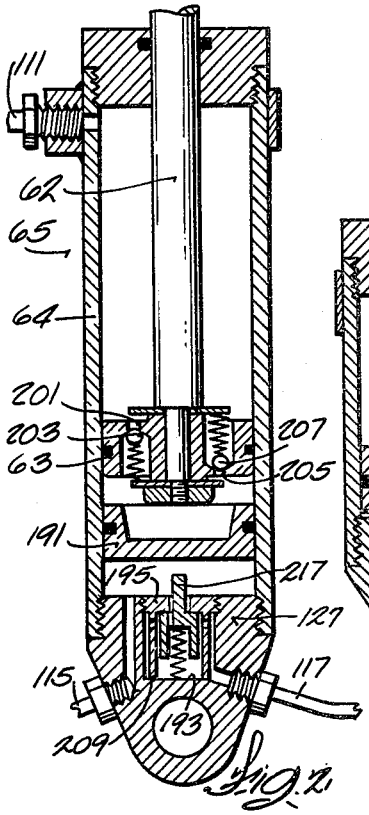
FIG. 2 is an enlarged cross-sectional view of the tilt cylinder-piston assembly incorporated in the outboard motor shown in FIG. 1.
Figure 3:
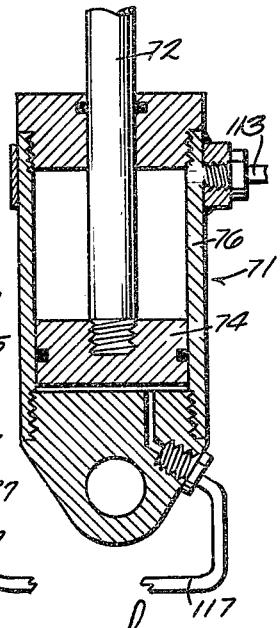
FIG. 3 is an enlarged cross-sectional view of the trim cylinder-piston assembly incorporated in the outboard motor shown in FIG. 1.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device in the form of an outboard motor 11 having a generally conventional propulsion unit 13 including, at the lower end thereof, a rotatably mounted propeller 15 driven by a propeller shaft 17. The outboard motor 11 also includes means 21 for pivotally mounting the propulsion unit 13 for pivotal movement in both the horizontal and vertical planes relative to a transom 23 of a boat 25, whereby to provide for steering movement of the propulsion unit 13 in the horizontal plane, and to provide for movement in the vertical plane of the propulsion unit 13 between a lowermost position with the propeller 15 fully submerged in water for driving propulsion and a raised position affording above-water accessibility to the propeller 15.

The means 21 for pivotally mounting the propulsion unit 13 includes a transom bracket means 31 which can be of unitary construction, or which can comprise several parts, and which is adapted to be fixedly mounted on the transom 23 of the boat 25.

The means 21 for pivotally mounting the propulsion unit 13 also includes a stern bracket 41 having an upper end 43, as well as first or upper pivot means 45 located rearwardly of the boat transom 23 and connecting the upper end 43 of the stern bracket 41 to the transom bracket means 31 for pivotal movement of the stern bracket 41 about a first or upper pivot axis 47 which is horizontal when the transom bracket means 31 is boat mounted. Any means for effecting such pivotal connection can be employed.

The means 21 for pivotally mounting the propulsion unit 13 further includes a swivel bracket 51, together with a lower or second pivot means 53 connecting the swivel bracket 51 to the stern bracket 41 at a point below the first pivot means 45 for pivotal movement of the swivel bracket 51 relative to the stern bracket 41 about a second or lower pivot axis 55 which is parallel to the first or upper pivot axis 47. Any means for effecting such pivotal connection can be employed.

The means 21 for pivotally mounting the propulsion unit 13 further includes means 61 for pivotally connecting the propulsion unit 13 to the swivel bracket 51 for movement in common with the swivel bracket 51 about the first and second or upper and lower pivot axes 47 and 55 and for steering movement of the propulsion unit 13 about a generally vertical axis relative to the swivel bracket 51. Any suitable means can be provided for pivotally connecting the swivel bracket 51 and the propulsion unit 13 and any suitable means can be employed for effecting steering displacement in a horizontal plane of the propulsion unit 13 relative to the swivel bracket 51.

The outboard motor 11 also includes means for displacing the swivel bracket 51 and connected propulsion unit 13 about the lower horizontal pivot axis 55 and about the upper horizontal pivot axis 47. In the construction illustrated in FIG. 1, such means comprises one or more tilt hydraulic cylinder-piston assemblies 65, each having an axis 67 and opposed ends 69 and 70. One end 69 is pivotally connected, by any suitable means, to the transom bracket means 31 and the other end 70 is pivotally connected, by any suitable means, to the stern bracket 41.

While other arrangements could be employed, in the disclosed construction, the tilt cylinder-piston assembly 65 comprises a tilt piston rod 62 having a first end pivotally connected to one of the stern bracket 41, a tilt piston 63 fixed to the other or second end of the tilt piston rod 62, and a tilt cylinder 64 receiving the tilt piston 63 and having a first or rod end through which the tilt piston rod 62 passes and a second or blind end pivotally connected to the other of the stern bracket 41 and the transom bracket means 31. In the disclosed construction, the second or blind end of the cylinder 64 is pivotally connected to the stern bracket 41.

In addition, the means for pivotally displacing the swivel bracket 51 and connected propulsion unit 13 includes one or more trim cylinder-piston assemblies 71, each having an axis 73 and opposed ends 75 and 76. One end 75 is pivotally connected, by any suitable means, to the stern bracket 41, and the other end 76 is pivotally connected, by any suitable means, to the swivel bracket 51.

While other arrangements are possible, in the disclosed construction, the trim cylinder-piston assembly 71 includes a trim piston rod 72 having a first end pivotally connected to the swivel bracket 51, a trim piston 74 fixed on the other or second end of the trim piston rod 72, and a trim cylinder 76 receiving the trim piston and having a first or rod end through which the trim piston rod 72 passes and a second or blind end pivotally connected to the stern bracket 41.

In order provided for sequential upward pivotal propulsion unit movement through the trim range and then through the tilt range when under thrust conditions, the pivotal connections of the trim cylinder-piston assembly 71 and the tilt cylinder-piston assembly 65 are located such that, when the swivel bracket 51 and connected propulsion unit 13 are in the lowermost position, the ratio of the perpendicular distances from the lower or second pivot axis 55 to the axis of the propeller 15 and to the axis 73 of the trim-cylinder-piston assembly 71 is less than the ratio of the perpendicular distances from the upper or first horizontal axis 47 to the axis of the propeller 15 and to the axis 67 of the tilt cylinder-piston assembly 65.

More specifically, it is noted that the moment arm between the upper pivot or tilt axis 47 and axis 67 of the tilt cylinder-piston assembly 65 is several times less than (approximately 20 percent of) the moment arm from the upper pivot or tilt axis 47 to the axis of the propeller 15. It is also noted that the moment arm from the lower pivot or trim axis 55 to the axis 73 of the trim cylinder-piston assembly 71 is less than (approximately 40 percent of) the moment arm from the lower pivot or trim axis 55 to the axis of the propeller 15. Thus, if the cross sectional dimension of the trim and tilt cylinder-piston assemblies 65 and 71 are about the same, substantially greater pressures are developed in the tilt cylinder-piston 65 assembly as compared to the trim cylinder-piston assembly 71 in response to propulsive thrust developed by the propeller 15.

If other mounting arrangement for the tilt and trim cylinder-piston assemblies 65 and 71 are employed, the desired sequential upward tilting movement, first through the trim range and then through the tilt range, can also be obtained by employing greater force exerted along the axis 73 of the trim cylinder-piston assembly 71 as compared to along the axis 67 of the tilt cylinder-piston assembly 65. Such greater force can be obtained by applying higher pressure hydraulic fluid to the trim cylinder-piston assembly 71 as compared to the tilt cylinder-piston assembly 65 and/or by increasing the cross section of the cylinder of the trim cylinder-piston assembly 71 as compared to the cylinder of the tilt cylinder-piston assembly 65.

Also included in the means for displacing the swivel bracket 51 and connected propulsion unit 13 about the upper and lower horizontal pivot axis 47 and 55, respectively, is a source of pressure fluid 81 and a fluid conduit system 83. The source of pressure fluid 81 includes a reversible electric pump 85 having opposed side ports 87 and 89 which alternately act as inlet and outlet ports depending upon the direction of pump rotation. The source of pressure fluid 81 communicates through the fluid conduit system 83 with a sump 91, which fluid conduit system 83 includes a first duct 93 including check valve means 95 permitting fluid flow therethrough from the sump 91 to the side port 87 of the pump 85 and preventing reverse flow, and a second duct 97 including check valve means 99 permitting fluid flow therethrough from the sump 91 to the other side port 89 of the pump 85 and preventing reverse flow. If desired the duct 97 and check valve 99 can be omitted, but their inclusion serves to prevent pump cavitation. In addition, a third duct 101 is provided between the side port 87 of the pump 85 and the sump 91 and includes a check valve 103 which serves as a pressure relief valve in the event of excessive pressure at the side port 87 of the pump 85 so as to permit return flow from the pump 85 to the sump 91. If desired a filter 90 can be employed between the sump 91 and the duct 93 and 97.

The fluid conduit system 83 also connects the source of pressure fluid 81 to the tilt and trim cylinder-piston assemblies 65 and 71, respectively. In this regard, the fluid conduit system 83 includes, in general, a first conduit 111 communicable between the source of pressure fluid 81 and the rod end of the tilt cylinder-piston assembly 65, a second conduit communicable between the source of pressure fluid 81 and the rod end of the trim cylinder-piston assembly 71, a third conduit 115 communicable between the source of pressure fluid 81 and the blind end of the tilt cylinder-piston assembly 65 and, a fourth conduit 117 communicable between the source of pressure fluid 81 and the blind end of the trim cylinder-piston assembly 71. While other arrangements are possible, in the disclosed construction, the fourth conduit 117 extends between the blind ends of the tilt and trim cylinder piston assemblies 65 and 71. If desired the fourth conduit 117 could communicate directly with the source of fluid pressure 81. Each of the first, second, third and fourth conduits 111, 113, 115 and 117, respectively, includes first, second, third, and fourth spring biased normally closed valves 121, 123, 125 and 127, respectively, which yieldably prevent flow from the cylinder-piston assemblies 65 and 71 to the pump 83. The springs biasing the valves 121, 123, 125 and 127 are relatively light and, according, in the absence of back pressure on these valves, little force is necessary to open them.

Means are provided for opening the normally closed valves 121 and 125 in the first and third conduits 111 and 115 in response to pump operation. In this regard, a control piston 131 is located in a control cylinder 135 and includes axially extending pins 137 and 139 which, in response to piston movement in the control cylinder 135, are respectively engageable with the normally closed valves 121 and 125 for opening thereof.

Means are also provided for opening the normally closed valve 123 in the second conduit 113 including a control piston 141 which is located in a control cylinder 145 and which, at one end, includes an axially extending pin 147 which, in response to piston movement in the control cylinder 145, is engageable with the normally closed valve 123 in the second conduit 113 for opening thereof.

The control cylinders 135 and 145 are connected, at their opposite ends, to the side ports 87 and 89 of the pump 85 by respective ducts 151 and 153. Thus, when the duct 151 communicating with the side port 87 is pressurized by the pump 85, the piston 131 moves to the right to open the normally closed valve 125 in the third conduit 115 so as thereby to enable drainage of pressure fluid from the blind end of the tilt cylinder-piston assembly 65 through the conduit 115 and from the blind end of the trim cylinder-piston assembly 71 through the conduit 115 and from conduit 117. Simultaneously, the pressure fluid, acting through the control cylinders 135 and 145, opens the normally closed valves 121 and 123 in the first and second conduits 111 and 113 so as to enable supply of pressure fluid through the conduits 111 and 113 to the rod ends of the tilt and trim cylinder-piston assemblies 65 and 71.

When the side port 89 is pressurized by the pump 85, pressure fluid in the duct 153 serves to displace the pistons 131 and 141 to the left so as to open the normally closed valves 121 and 123 in the first and second conduits 111 and 113 so as thereby to enable drainage of pressure fluid through the conduits 111 and 113 from the rod ends of the tilt and trim cylinder piston assemblies 65 and 71. At the same time, the pressure fluid in the control cylinder 135 operates to open the normally closed valve 125 in the third conduit 115 so as to enable supply of pressure fluid through the conduits 115 and 117 to the blind ends of the tilt and trim cylinder-piston assemblies 65 and 71.

As will be disclosed later herein, means are provided for opening the fourth normally closed valve 127 to provide sequential contraction of the trim cylinder-piston assembly 71 only after full contraction of the tilt cylinder-piston assembly 65.

The fluid conduit system 83 also includes a pressure relief valve 161 located in duct 163, communicating between the sump 91 and the third conduit 115 and operable, in response to a pressure level at the side port 89 of the pump 85 above a pre-determined level, or in response to excessive pressure in the blind end of the tilt cylinder-piston assembly 65, to permit return flow of pressure fluid to the sump 91. The valves 103 and 161 prevent pump overload when the propulsion unit 13 is in the lowermost and full tilt positions. The valve 161 also serves to limit the amount of forward thrust which can be carried by the tilt cylinder-piston assembly 65. Excessive thrust when the propulsion unit 13 is in the tilt range can possibly cause structural damage to the mounting components.

Figure 4:
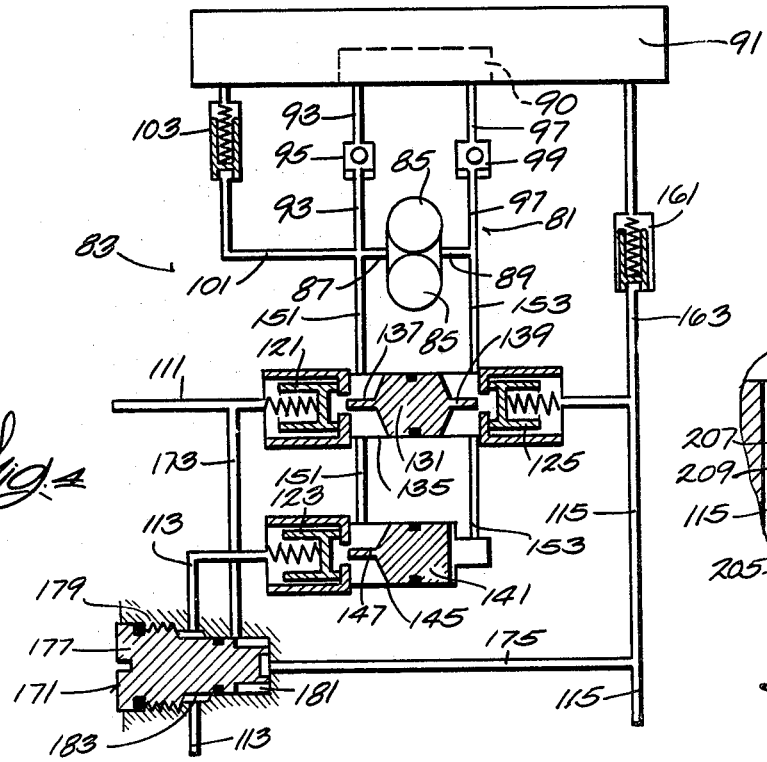
FIG. 4 is a schematic view of the pressure fluid supply and conduit system included in the outboard motor shown in FIG. 1.

The fluid conduit system 83 also includes a manual release valve 171 which allows free travel of the tilt and trim cylinder-piston assembly 65 and 71. The release valve 171 is sequentially operable to connect the first conduit 111 through the branch ducts 173 and 175 to the third conduit 115 and then to additionally connect the second conduit 113 through the branch duct 175 with the third conduit 115, while retaining communication between the first conduit 111 and third conduit 115. The manual release valve 171 includes a threaded valve member 177 which, in response a rotation thereof, is movable axially in a housing 179 and relative to the adjacent end of the branch duct 175 which communicates with the housing 179. When in the fully closed position shown in FIG. 4, the end of the valve member 177 closes the branch duct 175 so as to prevent flow from the first conduit branch duct 173 to the branch duct 175. However, initial outward valve member movement to the left in FIG. 4 serves to displace the end of the valve member 177 away from the branch duct 175 and thereby to permit fluid flow from the first conduit branch duct 173 into an annular space 181 between the end of the valve member 177 and the housing 179, and past the end of the valve member 177 to the branch duct 175. Further outward retraction toward the left in FIG. 4 of the valve member 177 serves to communicate an annular passage 183 forming a part of the second conduit 113 and the annular space 181 around the inner end of the valve member 177, thereby subsequently communicating the second conduit 113 with the branch duct 175.

In order to permit upward movement of the propulsion unit 13 in response to the striking of an underwater obstacle, the tilt piston 63 includes therein an orifice 201 and a spring biased check valve 203 which opens in response to substantially increased pressure at the rod end of the tilt cylinder 64 so as to permit flow from the rod end of the tilt cylinder 64 to the blind end of the tilt cylinder 64. Such movement of the fluid in the tilt cylinder 64 through the orifice 201 serves to permit extension of the tilt cylinder-piston assembly 65 and to absorb energy during rapid upward swinging movement of the propulsion unit 13 in response to the striking of an underwater obstacle.

The tilt piston 63 also includes therethrough a second orifice 205 and a spring biased valve 207 which serves to yieldably prevent fluid flow from the blind end of the tilt cylinder 64 to the rod end of the tilt cylinder 64. Such orifice permits contraction of the tilt cylinder piston assembly 65 during down movement of the stern bracket 51 and connected propulsion unit 13 subsequent to the striking of an underwater obstacle by permitting return flow of the hydraulic fluid from the rod end of the tilt cylinder 64, keeping in mind return flow of hydraulic fluid from the tilt cylinder 64 through the first conduit 111 to the source of pressure fluid 81 is prevented by the check valve 121. It is particularly noted that the check valves 121 and 123 in the first and second fluid conduits prevent flow from the tilt cylinder 64 to the sources of pressure fluid 81. Only in the exceptional situation where fluid pressure in the blind end of the tilt cylinder 64 exceeds the set value of the relief valve 161 will there be a flow from the tilt cylinder 64 to the sump 91.

It is especially noted as will be apparent hereinafter that, upon the striking of an underwater obstacle, the setting of the trim cylinder-piston assembly 71 is not disturbed, and that, upon downward return movement of the propulsion unit 13, the propulsion unit 13 will assume the same position as before impact.

The mounting arrangement of the tilt and trim cylinder-piston assemblies 65 and 71, including their respective moment arm considerations, and the fluid conduit system 83 just disclosed, provide means for displacing the swivel bracket 51 and connected propulsion unit 13 about the upper and lower horizontal axis 47 and 55 so as to cause, during upward movement and reverse operation of the propulsion unit 13, sequential full extension of the trim cylinder-piston assembly 71 followed by extension of the tilt cylinder piston assembly 65, and to cause, during downward movement and reverse operation of the propulsion unit 13, sequential full contraction of the tilt cylinder-piston assembly 65 followed by contraction of the trim cylinder-piston assembly 71.

With respect to sequential extension of the trim and tilt cylinder-piston assemblies 71 and 65, respectively, such action results from the employment of the separate valves 121 and 123 in the first and second conduits 111 and 113 as distinguished from controlling fluid flow through both conduits 111 and 113 by a single valve and thus to both the trim and tilt cylinder-assemblies 71 and 65, together with the previously described moment arm considerations. More specifically, because of the ratio of the perpendicular distances or moment arms from the upper pivot axis 47 to the tilt cylinder axis 67 and to the axis of the propeller 15 is less than the ratio of the perpendicular distances or moment arms from the lower pivot axis 55 to the trim cylinder axis 73 and to the axis of the propeller 15, greater hydraulic pressure is required to tilt than to trim. Consequentially, during rearward propulsive movement, the back pressure in the tilt cylinder is greater than in the trim cylinder. Accordingly, the pressures at the rod ends of the tilt cylinder-piston assembly 65 and of the trim cylinder-piston assembly 71 are imposed respectively upon the backside of the valves 121 and 123. Accordingly, initial fluid pressure developed by the pump 85 will only be sufficient to cause operation of the control piston 141 to open the valve 123 against the back pressure from the trim cylinder-piston assembly 71 and thus to permit extension of the trim cylinder-piston assembly 71 by draining fluid from the rod end thereof through the conduit 113, through the valve 123, and through the duct 151 to the pump side port 87. However, the initial fluid pressure will be insufficient to cause the piston 131 to open the valve 121 in the first conduit 111 due to the greater back pressure at the rod end of the tilt cylinder-piston assembly 65. Thus, during initial pressurization which is effective to extend the trim cylinder-piston assembly 71, the back pressure at the rod end of the tilt cylinder-piston assembly 65 serves to maintain closed the valve 121 in the first conduit 111. However, upon full extension of the trim cylinder-piston assembly 71, the pump 85 will develop an increased pressure of sufficient magnitude to overcome the back pressure at the rod end of the tilt cylinder-piston assembly 65 and thereby to permit opening by the control piston 131 of the valve 121 in the first conduit 111. Consequently, the fluid in the rod end of the tilt cylinder-piston assembly 65 will drain through the first conduit 111, through the valve 121, and through the duct 151 to the side port 87 of the pump 85. Thus, the arrangement of the separate valves 121 and 123 cooperates with the moment arm considerations to insure that the trim cylinder-piston assembly 71 extends completely before extension of the tilt cylinder-piston assembly 65, notwithstanding operation of the propulsion unit 13 in reverse which tends to upwardly tilt the propulsion unit 13.

The means for causing sequential full contraction of the tilt cylinder-piston assembly 65 followed by contraction of the trim cylinder-piston assembly 71 during reverse operation of the propulsion unit 13, and during downward movement of the propulsion unit 13, includes means for opening the normally closed valve 127 in the fourth conduit 117. Various mechanical and/or electrical arrangements can be employed depending, in part, on the arrangement of the fourth conduit 117, for opening of the valve 127 upon full contraction of the tilt cylinder-piston assembly 65. In the disclosed construction, such means comprises a floating non-valved piston 191 which is located in the tilt cylinder-piston assembly 65 between the blind cylinder end and the tilt piston 63.

Figure 5:
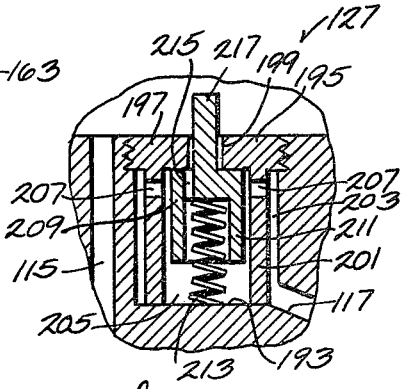
FIG. 5 is an enlarged fragmentary sectional view of a portion of the tilt cylinder-piston assembly shown in FIG. 2.

In addition, and as shown best in FIG. 5, the valve 127 is located in a recess 193 which is located in the blind end of the cylinder 64, which forms part of the conduit 117, and which, at its upper end is threaded to receive a closure 195 having a transverse wall 197 with a central aperture 199 and a skirt 201 extending downwardly from the transverse wall 197. When the closure 195 is fully threaded into the recess 193, the bottom of the skirt 195 sealingly engages the bottom of the recess 193 so as to provide the conduit 117 with an annular portion 203 outwardly of the skirt 195 and to provide a valve chamber 205 inwardly of the skirt 195. Located in the upper portion of the skirt 195 just below the transverse wall 197 are one or more valve ports or apertures 207 communicating between the valve chamber 205 and the annular conduit portion 203.

Located in the valve chamber 205 is a piston type valve member 209 including a skirt 211 which wipes the skirt 201 to open and close the valve ports 207 depending upon the position of the valve member 209 in the valve chamber 205. The valve member 209 is biased upwardly by a suitable spring 213 into engagement with the transverse wall 197, thereby also closing the valve ports 207.

Extending axially through the valve member 209 is a vent or duct 215 permitting fluid flow therethrough during valve member movement.

Extending fixedly from the valve member 209 through the aperture 199 and into the bore of the cylinder 64 is a pin 217 which, when engaged by the floating piston 191, axially displaces the valve member 209 downwardly against the action of the spring 213 to open the valve ports 207.

Upon down movement of the propulsion unit 13 from the raised position, and notwithstanding reverse operation of the propulsion unit 13 which tends to tilt the propulsion unit 13 upwardly, pressure fluid supplied by the pump 85 through the duct 151 causes the control piston 131 to move to the right, thereby opening the valve 125 for return fluid flow from the tilt and trim cylinder-piston assemblies 65 and 71 through the third conduit 115 to the side port 89 of the pump 85. Such pressure fluid supply through the duct 151 also opens both valves 121 and 123 so as to supply pressure fluid to the rod ends of the tilt and trim cylinder-piston assemblies 65 and 71, and thereby to urge the pistons thereof toward the blind ends of the tilt and trim cylinder-piston assemblies 65 and 71. The application of such pressure fluid to the rod end of the trim cylinder-piston assembly 71 will be ineffective to contract the trim cylinder-piston assembly 71 due to the closed condition of the valve 127. However, application of such pressure fluid to the tilt cylinder-piston assembly 65 will cause contraction thereof and displacement of the tilt piston toward the blind end of the tilt cylinder. During such movement, pressure fluid drains from the blind end of the tilt cylinder to the side port 89 of the pump 85. However, as noted, pressure fluid in the blind end of the trim cylinder is captured, preventing contraction of the trim cylinder-piston assembly 71 by reason of the valve 127. However, upon full contraction of the tilt cylinder-piston assembly 65, the floating piston 191 is displaced by the tilt piston 63 to the blind end of the tilt cylinder 64, thereby engaging the pin 217 to open the valve 127. Such action permits drainage of the blind end of the trim cylinder 76, and contraction thereof in response to the supply of fluid under pressure from the pump 85 to the rod end of the trim cylinder 76. Thus, and notwithstanding the reverse propulsion unit operation which tends to cause extension of both the tilt and trim cylinder-piston assemblies 65 and 71, the trim cylinder-piston assembly 71 is contracted only after full contraction of the tilt cylinder-piston assembly 65.

It is noted that because of the duct 215, fluid pressure is equal on both sides of the valve member 209 and, accordingly, fluid pressure alone is incapable of moving the valve member 209. However, whenever the tilt cylinder-piston assembly 65 is fully contracted, i.e., when the stern bracket 41 is in its lowermost position, the floating piston 191 engages the pin 217 so as to open the valve 127. Thus, upon application of pressure fluid through the conduit 115, the open valve 127 will permit fluid flow therethrough to the conduit 117 and to the trim cylinder-piston assembly 71. Thus, as already indicated, because of moment arm considerations, the trim cylinder-piston assembly 71 will extend prior to extension of the tilt cylinder-piston assembly 41.

Various of the features of the invention are set forth in the following claims.

We claim:

1. A marine propulsion device comprising transom bracket means adapted to be connected to a boat transom, a stern bracket, first pivot means connecting said stern bracket to said transom bracket means for pivotal movement of said stern bracket relative to said transom bracket means about a first pivot axis which is horizontal when said transom bracket means is boat mounted, a swivel bracket, second pivot means connecting said swivel bracket to said stern bracket below said first pivot means for pivotal movement of said swivel bracket with said stern bracket and relative to said stern bracket about a second pivot axis parallel to said first pivot axis, a propulsion unit operable to provide forward and reverse propulsion and including, at the lower end thereof, a rotatably mounted propeller, means pivotally connecting said propulsion unit to said swivel bracket for steering movement of said propulsion unit relative to said swivel bracket about a generally vertical axis and for common pivotal movement with said swivel bracket in a vertical planes about said first and second horizontal axes, a trim cylinder-piston assembly pivotally connected to said stern bracket and to said swivel bracket, a tilt cylinder-piston assembly pivotally connected to said transom bracket means and to said stern bracket, a source of pressure fluid, and a fluid conduit system communicating between said source of pressure fluid and each of said tilt cylinder-piston assembly and said trim cylinder-piston assembly and including means operable, during upward tilting and reverse propulsion of said propulsion unit, for causing initial full extension of said trim cylinder-piston assembly, followed by extension of said tilt cylinder-piston assembly and, during downward tilting and reverse propulsion of said propulsion unit, for causing initial full contraction of said tilt cylinder-piston assembly, followed by subsequent contraction of said trim cylinder-piston assembly.

2. A marine propulsion device in accordance with claim 1 wherein said trim cylinder-piston assembly includes a trim piston rod having a first end pivotally connected to one of said stern bracket and said swivel bracket and having a second end, a trim piston fixed on said second end of said trim piston rod, and a trim cylinder receiving said trim piston and having a first end through which said trim piston rod passes and a second end pivotally connected to the other of said swivel bracket and said stern bracket, wherein said tilt cylinder-piston assembly comprises a tilt piston rod having a first end pivotally connected to one of said transom bracket means and said stern bracket and having a second end, a tilt piston fixed to said second end of said tilt piston rod, a tilt cylinder receiving said tilt piston and having a first end through which said tilt piston rod passes and a second end pivotally connected to the other of said transom bracket means and said stern bracket, and wherein said means operable during reverse operation of said propulsion unit for causing initial full extension of said trim cylinder-piston assembly followed by extension of said tilt cylinder-piston assembly comprises a first conduit communicating between said source of pressure fluid and said first end of said tilt cylinder and including valve means normally biased closed, and a second conduit communicating between said source of pressure fluid and said first end of said trim cylinder and including valve means normally biased closed.

3. A marine propulsion device in accordance with claim 1 wherein said means operable during reverse operation of said propulsion unit for causing initial full contraction of said tilt cylinder-piston assembly followed by subsequent contraction of said trim cylinder-piston assembly comprises conduit means communicating between said source of pressure fluid and said second end of said trim cylinder and including valve means normally biased closed so as to prevent flow in said conduit means from said trim cylinder to said source of pressure fluid.

4. A marine propulsion device in accordance with claim 3 wherein said means operable during reverse operation of said propulsion unit for causing initial full contraction of said tilt cylinder-piston assembly followed by subsequent contraction of said trim cylinder-piston assembly includes means for opening said valve means in said conduit means upon full contraction of said tilt cylinder-piston assembly.

5. A marine propulsion device in accordance with claim 4 wherein said conduit means includes a third conduit communicating between said source of pressure fluid and said second end of said tilt cylinder and a fourth conduit communicating between said second ends of said tilt and trim cylinders and including said valve means in said conduit means.

6. A marine propulsion device in accordance with claim 5 wherein said means for opening said valve means in said conduit means comprises a floating piston located in said tilt cylinder between said tilt piston and said second end of said tilt cylinder and including means thereon engageable with said valve means in said conduit means for opening thereof upon full contraction of said tilt cylinder-piston assembly, whereby thereafter to permit drainage from said second end of said trim cylinder and contraction of said trim cylinder-piston assembly.

7. A marine propulsion device in accordance with claim 2 wherein said tilt piston includes first check valve means affording fluid flow in the direction from said first tilt piston rod end to said second rod end, and second check valve means affording fluid flow in the opposite direction.

8. A marine propulsion device in accordance with claim 1 wherein said first pivot means is located rearwardly of the boat transom.

9. A marine propulsion device comprising transom bracket means adapted to be connected to a boat transom, a stern bracket, first pivot means connecting said stern bracket to said transom bracket means for pivotal movement of said stern bracket relative to said transom bracket means about a first pivot axis which is horizontal when said transom bracket means is boat mounted, a swivel bracket, second pivot means connecting said swivel bracket to said stern bracket below said first pivot means for pivotal movement of said swivel bracket with said stern bracket and relative to said stern bracket about a second pivot axis parallel to said first pivot axis, a propulsion unit operable to provide forward and reverse propulsion and inluding, at the lower end thereof, a rotatably mounted propeller, means pivotally connecting said propulsion unit to said swivel bracket for steering movement of said propulsion unit relative to said swivel bracket about a generally vertical axis and for common pivotal movement with said swivel bracket in a vertical plane about said first and second horizontal axes, a trim cylinder-piston assembly pivotally connected to said stern bracket and to said swivel bracket, a tilt cylinder-piston assembly pivotally connected to said transom bracket means and to said stern bracket, a source of pressure fluid, and a fluid conduit system communicating between said source of pressure fluid and each of said tilt cylinder-piston assembly and said trim cylinder-piston assembly and including means operable, during upward tilting and reverse propulsion of said propulsion unit, for causing initial full extension of said trim cylinder-piston assembly, followed by extension of said tilt cylinder-piston assembly.

10. A marine propulsion device comprising transom bracket means adapted to be connected to a boat transom, a stern bracket, first pivot means connecting said stern bracket to said transom bracket means for pivotal movement of said stern bracket relative to said transom bracket means about a first pivot axis which is horizontal when said transom bracket means is boat mounted, a swivel bracket, second pivot means connecting said swivel bracket to said stern bracket below said first pivot means for pivotal movement of said swivel bracket with said stern bracket and relative to said stern bracket about a second pivot axis parallel to said first pivot axis, a propulsion unit operable to provide forward and reverse propulsion and including, at the lower end thereof, a rotatably mounted propeller, means pivotally connecting said propulsion unit to said swivel bracket for steering movement of said propulsion unit relative to said swivel bracket about a generally vertical axis and for common pivotal movement with said swivel bracket in a vertical plane about said first and second horizontal axes, a trim cylinder-piston assembly pivotally connected to said stern bracket and to said swivel bracket, a tilt cylinder-piston assembly pivotally connected to said transom bracket means and to said stern bracket, a source of pressure fluid, and a fluid conduit system communicating between said source of pressure fluid and each of said tilt cylinder-piston assembly and said trim cylinder-piston assembly and including means operable, during downward tilting and reverse propulsion of said propulsion unit, for causing initial full contraction of said tilt cylinder-piston assembly, followed by subsequent contraction of said trim cylinder-piston assembly.

* * * * *